US009534841B2

(12) United States Patent
Yang et al.

(10) Patent No.: US 9,534,841 B2
(45) Date of Patent: Jan. 3, 2017

(54) PHASE CHANGE MATERIAL INJECTION DEVICE AND STRUCTURE FOR REMOVING MOISTURE OF HEAD LAMP WITH THE SAME

(71) Applicants: Hyundai Motor Company, Seoul (KR); Hyundai Mobis Co., Ltd., Seoul (KR)

(72) Inventors: Jeong Gyu Yang, Gyeonggi-do (KR); Byung-Ook Park, Seoul (KR); Sae-Jun Park, Daegu (KR)

(73) Assignees: Hyundai Motor Company, Seoul (KR); Hyundai Mobis Co., Ltd., Seoul (KR)

( * ) Notice: Subject to any disclaimer, the term of this patent is extended or adjusted under 35 U.S.C. 154(b) by 491 days.

(21) Appl. No.: 14/145,055

(22) Filed: Dec. 31, 2013

(65) Prior Publication Data

US 2014/0283405 A1 Sep. 25, 2014

(30) Foreign Application Priority Data

Mar. 19, 2013 (KR) ..... 10-2013-0029327

(51) Int. Cl.

| | |
|---|---|
| ***F26B 19/00*** | (2006.01) |
| ***F26B 21/00*** | (2006.01) |
| ***F21S 8/10*** | (2006.01) |

(52) U.S. Cl.

CPC ..... *F26B 19/00* (2013.01); *F21S 48/335* (2013.01); *F26B 21/006* (2013.01)

(58) Field of Classification Search

CPC ..... F26B 19/00; F26B 21/006; F21S 48/335

See application file for complete search history.

(56) References Cited

U.S. PATENT DOCUMENTS 8,827,522 B2 * 9/2014 Yang ..... B60Q 1/04 362/547

FOREIGN PATENT DOCUMENTS

| | | | |
|---|---|---|---|
| JP | 2002-372748 | A | 12/2002 |
| JP | 2009021245 | A | 1/2009 |
| KR | 10-2003-0076075 | A | 9/2003 |
| KR | 10-0551827 | | 2/2006 |
| KR | 10-1043278 | | 6/2011 |

* cited by examiner

*Primary Examiner* — Jiping Lu

(74) *Attorney, Agent, or Firm* — Mintz Levin Cohn Ferris Glovsky and Popeo, P.C.; Peter F. Corless

(57) ABSTRACT

Disclosed is a phase change material injection device, which is disposed in a housing or a vehicle headlamp in which a predetermined heat source is provided. The phase change material injection device is configured to eject a phase change material, which has been changed into a gas from liquid by heating of the heat source, into the housing, and may include: i) a container storing the phase change material in a liquid state; ii) a discharge unit disposed at the container for discharging a predetermined amount of the phase change material in a gas state; and iii) a valve unit having an ejection port connecting the discharge unit with the inside of the housing, disposed at the container, the valve unit selectively opening and closing the ejection port based on the internal temperature of the housing.

11 Claims, 5 Drawing Sheets

PHASE CHANGE MATERIAL INJECTION DEVICE AND STRUCTURE FOR REMOVING MOISTURE OF HEAD LAMP WITH THE SAME

CROSS-REFERENCE TO RELATED APPLICATION

This application claims priority to and the benefit of Korean Patent Application No. 10-2013-0029327 filed in the Korean Intellectual Property Office on Mar. 19, 2013, the entire contents of which are incorporated herein by reference.

BACKGROUND OF THE INVENTION (a) Field of the Invention

The present invention relates to a headlamp for a vehicle, and a structure for removing moisture of a headlamp with the same. More particularly, the present invention relates to a phase change material injection device that can remove moisture produced in a headlamp.

(b) Description of the Related Art

In general, the headlamps of vehicles are important electric devices that provide road visibility for drivers traveling at night or under reduced light conditions. However, the lenses of the headlamps of vehicles are fogged by a difference in temperature between the inside and the outside of the headlamp due to heat generated by the lamps.

As one method for removing moisture in the headlamps, for example, there is a method of using convection, by circulating the air in the headlamps.

Various other methods of minimizing the difference in temperature between the inside and the outside of the headlamp by preventing an increase in temperature of the air in the headlamps have been used.

Despite these attempts, the headlamp fogging problem persists. Thus, there is a need for improved methods and devices for eliminating such fogging.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention provides a phase change material injection device that prevents gas state vapor water from condensing on a headlamp by injecting a phase change material into the headlamp, wherein the phase change material changes into a gas state from a liquid state by heat generated by a heat source, and a structure for removing moisture of a headlamp with the device. The heat source may be, for example, the light source (lamp) of the headlamp.

According to one aspect, the present invention provides a phase change material injection device, which is disposed in a housing in which a predetermined heat source is also disposed. The phase change material injection device ejects a phase change material, which has been changed from liquid into a gas state by exposure to heat generated by the heat source, into the housing. Preferably, the phase change material changes in state during or prior to ejection into the housing. According to various embodiments, the device includes: i) a container for storing the phase change material in a liquid state; ii) a discharge unit disposed at the container for discharging a predetermined amount of the phase change material in a gas state; and iii) a valve unit disposed at the container and having an ejection port connecting the discharge unit with the inside of the housing, and the ejection port being selectively opened/closed based on the internal temperature of the housing.

According to various embodiments, the container includes a lower case and an upper case fitted to the upper portion of the lower case, wherein the upper and lower case form a space for storing the phase change material in a liquid state.

According to various embodiments, the discharge unit includes: an outlet formed at the upper portion of the container for allowing the phase change material in a gas state to be discharged; and at least one threaded member threadably-fastened to the outlet, the threaded member configured and arragned to form an ejection path for ejecting the phase change material in a gas state, and to control the ejection amount of the phase change material.

According to various embodiments, the ejection path is formed between the inner side of the outlet and a thread of the threaded member.

According to various embodiments, the discharge unit controls the discharge amount of the phase change material in a gas state through the discharge path, wherein the discharge amount is in accordance with the number of threads in and length of the threaded member.

According to an exemplary embodiment of the present invention, the discharge unit discharges the phase change material in a gas state at a flow rate of about 0.04 g/hr by means of the threaded member.

According to various embodiments, the threaded member is disposed at the upper portion and the lower portion of the outlet.

According to various embodiments, the valve unit includes: a valve body having the ejection port and being coupled to the upper portion of the container; a stopper movably disposed in the valve body and being configured and arranged for selectively opening/closing the ejection port; and a deformable member disposed at the valve body, the deformable member supporting the stopper. The deformable member deforms, particularly in it's form/shape, based on the internal temperature of the housing. The deformable member may be made of any material that provideus such deformation, and for example, may be formed of a bimetal.

According to various embodiments, the deformable member is disposed at the valve body and at least partially covers the stopper.

According to various embodiments, the stopper is movable by ejection pressure of the phase change material due to deformation of the deformable member and by a restoring force of the deformable member (i.e. upon restoration of the deformable member back to the non-deformed state).

According to another aspect, the present invention provides a structure for removing moisture of a vehicle headlamp, particularly by removing moisture produced in the headlamp housing in which a lamp as a heat source is disposed. The structure may include a phase change material injection device that is disposed in the housing and that ejects a phase change material into the housing, wherein the phase change material is changed from a liquid into a gas state by heating of the lamp. Preferably, the phase change material changes into a gas state prior to or during its ejection into the housing.

According to various embodiments, the phase change material injection device is disposed towards a bottom portion, such as on the bottom surface, of the housing.

According to various embodiments, a moisture discharge port for discharging moisture is formed in the housing.

The present invention, thus, provides an injection device and structure that prevent the generation of moisture in a vehicle headlamp, particularly by decreasing the dew point temperature in a housing of the headlamp by ejecting a phase change material into the housing. In particular, the phase change material is one which changes from a liquid into a gas state by heat generated by a lamp in the housing.

Further, the present invention makes it possible to eject a phase change material in a gas state into the housing under a specific temperature condition in the housing by turning-on and heating of the lamp, particularly by using a bimetal, and without a specific sensor or electronic device. Further, it is possible to control the ejection amount of the phase change material by means of a threaded member, such that it is possible to increase the lifespan of the device for removing moisture of a headlamp.

Other aspects and exemplary embodiments of the invention are discussed infra.

BRIEF DESCRIPTION OF THE DRAWINGS

The above and other features and advantages of the present invention will become more apparent by describing in detail exemplary embodiments thereof with reference to the attached drawings in which.

<Description of symbols>

Figure 1:
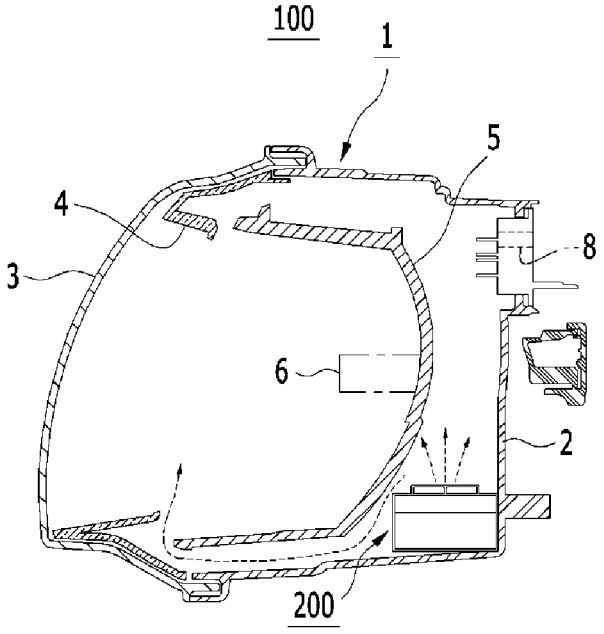
FIG. 1 is a view schematically showing a structure for removing moisture as disposed within the housing of a headlamp according to an exemplary embodiment of the present invention.

| | |
|---|---|
| 1: Headlamp | 2: Housing |
| 3: Lens | 4: Bezel |
| 5: Reflector | 6: Lamp |
| 8: Moisture discharge port | 10: Container |
| 11: Lower case | 12: Upper case |
| 15: Bolt | 16: Flange |
| 17: Gasket | 20: Phase change material(PCM) |
| 30: Discharge unit | 31: Outlet |
| 33: Threaded member | 34: Thread |
| 35: Ejection path | 60: Valve unit |
| 61: Valve body | 63: Ejection port |
| 71: Stopper | 81: Deformable member |

100: Structure for removing moisture of a headlamp

200: Material injection devicelt should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE EMBODIMENTS

Hereinafter, the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

The unrelated parts to the description of the exemplary embodiments are not shown to make the description clear and like reference numerals designate like element throughout the specification.

Further, the sizes and thicknesses of the configurations shown in the drawings are provided selectively for the convenience of description, so that the present invention is not limited to those shown in the drawings and the thicknesses are exaggerated to make some parts and regions clear.

Discriminating the names of components with the first, the second, etc. in the following description is for discriminating them for the same relationship of the components and the components are not limited to the order in the following description.

Throughout the specification, unless explicitly described to the contrary, the word "comprise" and variations such as "comprises" or "comprising", will be understood to imply the inclusion of stated elements but not the exclusion of any other elements.

Further, the terms, " . . . unit", " . . . mechanism", " . . . portion", " . . . member" etc. used herein mean the unit of inclusive components performing at least one or more functions or operations.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

FIG. 1 is a view schematically showing a structure for removing moisture of a headlamp according to an exemplary embodiment of the present invention.

Referring to FIG. 1, a structure 100 for removing headlamp moisture according to an exemplary embodiment of the present invention can be used for a headlamp 1 disposed at both sides on the front of a vehicle. Such a headlamp 1 typically emits light in a generally forward direction.

For example, as shown in FIG. 1, the headlamp 1 includes a housing 2 equipped with a lens 3 on the front, a bezel 4 disposed at a front portion within the housing 2, a reflector 5 disposed at a rear portion within the housing 2, and a lamp 6 disposed on the reflector 5. For example, the lamp 6 may be disposed on a surface of the reflector 5 facing the lens 3

The general features and components of the headlamp 1 may be in accordance with a headlamp assembly known in the art, so the configuration thereof is not described in further detail herein.

In the headlamp 1, the lens 3 can become fogged if there is a difference in temperature between the inside and the outside of the housing 2. This can result when the air in the housing 2 is heated by heat produced when the lamp 6 is turned on.

The structure 100 for removing moisture of a headlamp according to an exemplary embodiment of the present invention can prevent fogging in the housing 2 by decreasing the dew point temperature in the housing 2. The structure 100 of the present invention is further provided with a simple configuration.

As shown in FIG. 1, the structure 100 for removing moisture of a headlamp according to an exemplary embodiment of the present invention includes a phase change material injection device 200 that is disposed within the housing 2. The phase change material injection device 200 injects a phase change material 20 into the housing 2. In particular, the phase change material 20 is one which has been changed from a liquid state into a gas state by heat produced by the lamp 6, which is a heat source. According to various embodiments, the phase change material 20 is generally stored in the phase change material injection device 200 in a liquid state and, at some point prior to or while it is injected into the housing 2, it is changed into a gas state.

As shown in FIG. 1, the phase change material injection device 200 may be is disposed at a bottom portion of the housing, such as on a bottom surface in the housing 2, wherein the housing 2 further has a moisture discharge port 8 provided therein for discharging moisture. The structure for combining the phase change material injection device 200 with the housing 2 will be described in more detail below.

The phase change material injection device 200 according to an exemplary embodiment of the present invention has a structure that can minutely eject a phase change material 20 in a gas state into the housing under a specific temperature condition in the housing 2 due to turning-on and heating of the lamp 6. In particular, this ejection can be provided without a specific sensor or electronic device. Further, the phase change material injection device 200 controls the ejection amount of the phase change material 20.

Figure 2:
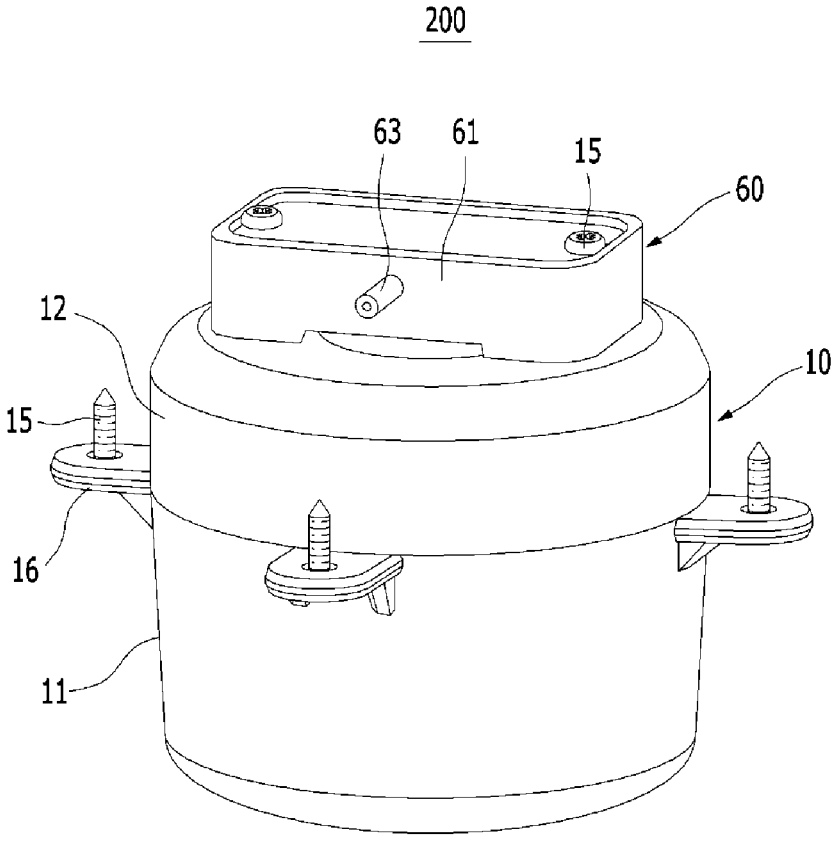
FIG. 2 is a perspective view showing a phase change material injection device according to an exemplary embodiment of the present invention.
Figure 3:
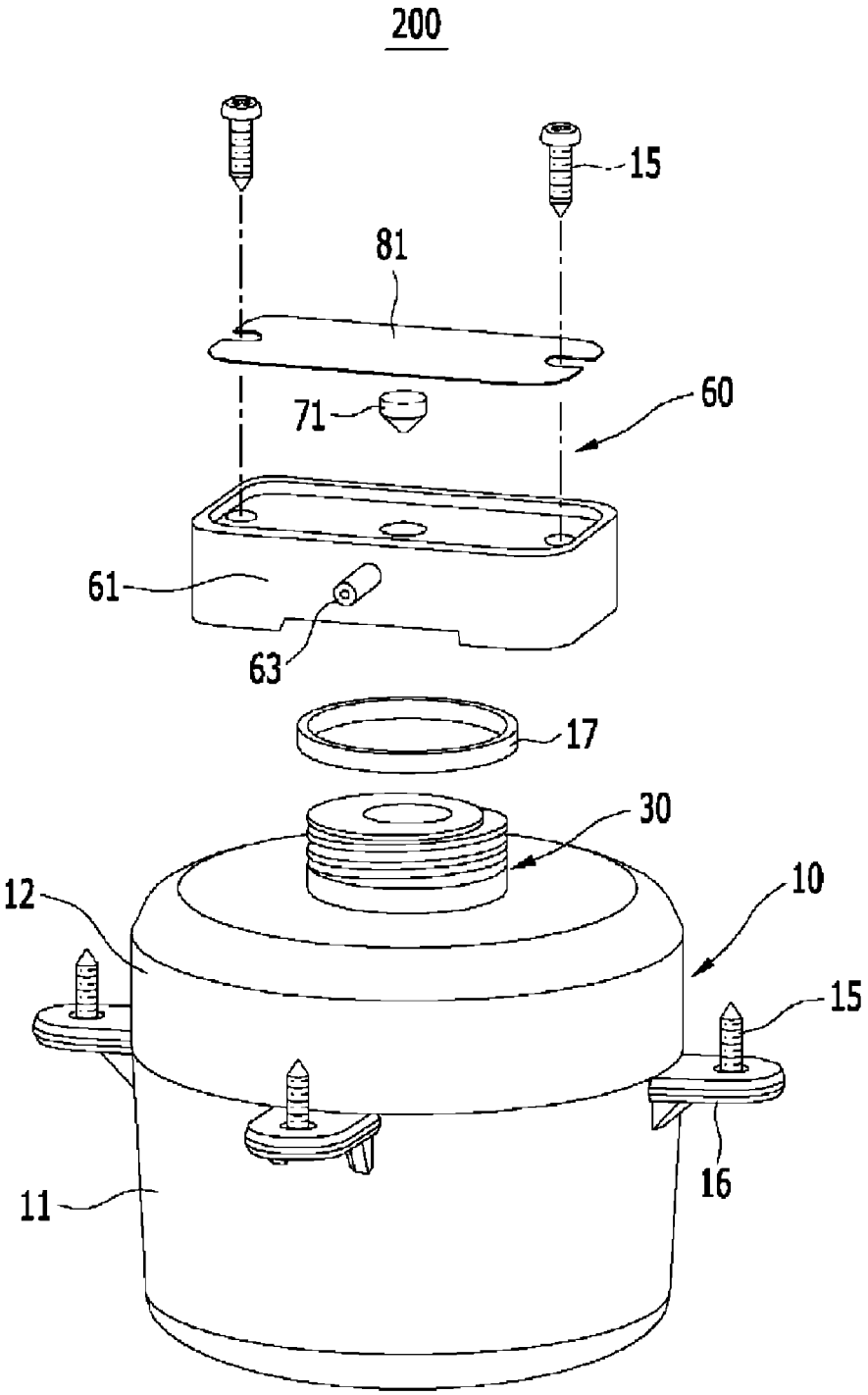
FIG. 3 is an exploded perspective view of FIG. 2.
Figure 4:
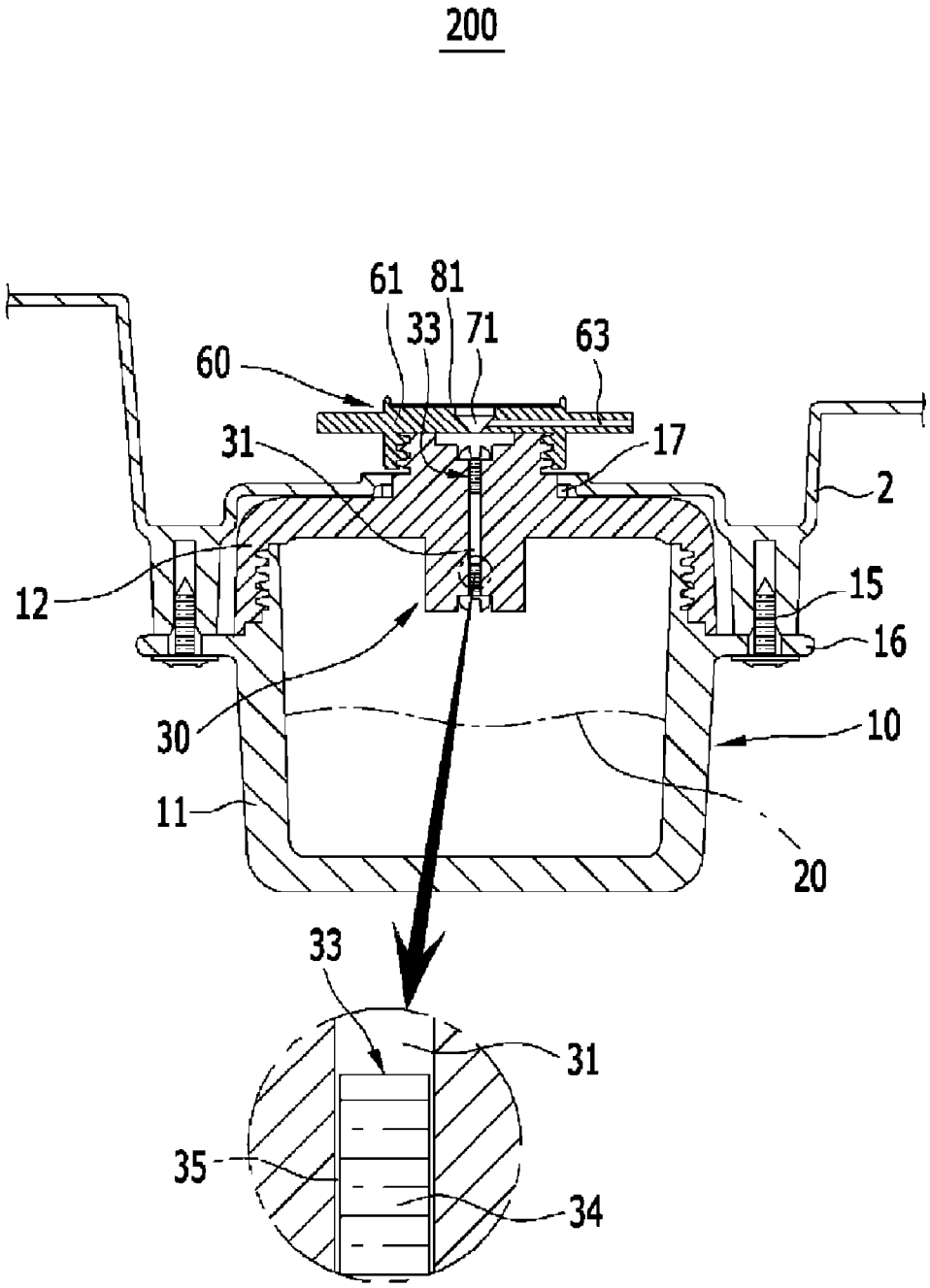
FIG. 4 is a cross-sectional view showing the configuration of FIG. 2.

The phase change material injection device 200 according to an exemplary embodiment of the present invention is described hereafter in detail with reference to FIGS. 2 to 4.

FIG. 2 is a perspective view showing a phase change material injection device 200 according to an exemplary embodiment of the present invention, FIG. 3 is an exploded perspective view of FIG. 2, and FIG. 4 is a cross-sectional view showing the configuration of FIG. 2.

Referring to FIGS. 2 to 4 with FIG. 1, the phase change material injection device 200 according to an exemplary embodiment of the present invention basically includes a container 10, a discharge unit 30, and a valve unit 60.

In the exemplary embodiment of the present invention, the container 10 is a high-pressure container configured for storing a phase change material (PCM) 20 in a liquid state.

According to various embodiments, the phase change material 20 may be a refrigerant mixture that maintains a liquid state at room temperature and changes in phase into a gas state at a temperature around 50° C. or above.

The phase change material 20 is not limited to any specific material herein. In particular, such phase change materials are known in the art, and any such known materials may suitably be used.

The container 10 may be provided as a generally one-piece container or may include a lower case 11 and an upper case 12, such as that shown in the figures, which are combined with each other to form the container 10.

The lower case 11 may be disposed and positioned in the housing 2 so as to be secured therein through any conventional means. For example, the lower case 11 may be secured to the housing 2 by bolts 15 which may be inserted through flanges 16 in formed around the outer side of the lower case 11.

The upper case 12 is attachable to the lower case 11 and, when the upper and lower cases 11, 12 are combined, they form a space for storing the liquid state phase change material 20. The lower portion of the upper case 12 can be attached to the upper portion of the lower case 11 through any conventional means such as, for example, threaded-fastenings.

Figure 5:
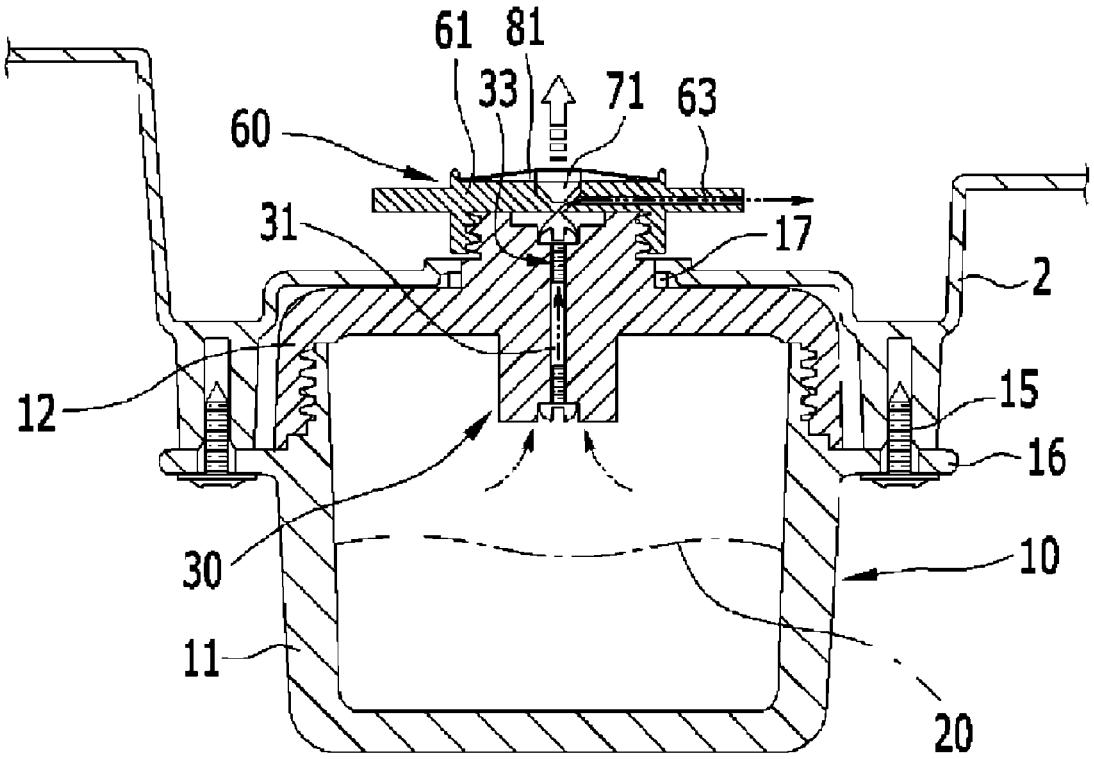
FIG. 5 is a cross-sectional view showing the configuration of FIG. 2 to illustrate the operation process of the phase change material injection device according to an exemplary embodiment of the present invention.

As shown in FIGS. 4-5 a gasket 17 may be disposed between the upper case 12 and the housing 2 to seal a gap therebetween.

Although an exemplary embodiment of the present invention specifies the use and storage in the container 10 of a phase change material 20 that changes phase from a liquid state into a gas state when heat is applied, the present invention is not limited thereto. Thus, for example, the container 10 may instead store a high-pressure gas.

In an exemplary embodiment of the present invention, a discharge unit 30 is provided for discharging the phase change material 20 from the container 10 by a predetermined amount. According to a preferred embodiment, the phase change material 20 changes from a liquid state to a gas state within the container 10.

The discharge unit 30 may be disposed in an upper portion of the container 10, such as in the upper case 12 of the container 10. This discharge unit is provided so as to communicate with the space in the housing 2 such that the phase change material 20 is discharged from the container 10 directly into the housing.

As shown in the embodiment of FIGS. 4 and 5, the discharge unit 30 includes an outlet 31 formed in the upper case 12 and at least one threaded member 33 disposed in the outlet 31.

In particular, the outlet 31 is a discharge channel that is in communication with the space in the container 10 through the upper case 12.

Further, the threaded member 33 is threadably-fastened to the outlet 31, and forms an ejection path 35 for ejecting the gas state phase change material 20. Preferably, the threaded member 33 is configured so as to substantially control the ejection amount of the phase change material 20 through the outlet 31.

The threaded member 33 is also called a tap-tight-screw in the related art. The configuration of the threaded member 33 can, thus, be in accordance with the general structure of such known members. The threaded member 33 is preferably threadably-fastened to the inner side of the outlet 31 by a thread 34, such that an ejection path 35 which is a small gap is formed between the inner side of the outlet 31 and the thread 34.

The discharge unit 30 according to an exemplary embodiment of the present invention can control the discharge amount of the gas state phase change material 20 through the ejection path 35. In particular, the discharge amount can be controlled based on the number of threads and length of the threaded member 33.

For example, the threaded members 33 may be disposed at both the upper and lower ends of the outlet 31. Accordingly, the upper and lower threaded members 33 form the ejection paths 35 at the upper and lower ends, respectively. This provides for the discharge of the gas state phase change material 20 at a desired flow rate such as, for example a flow rate of about 0.04 g/hr. However, this flow rate is only used as a example, and the present method is not limited thereby.

In this configuration, the length and the outer diameter of the threaded member 33 may depend on the desired discharge amount of the gas state phase change material. As such, the length and outer diameter, as well as the flow rate are not necessarily limited to specific values herein but, rather, may be varied and adjusted to provide desired results. For example, if the outer diameter of the threaded member 33 is increased, the diameter of the ejection path 35 also is increased, and thus flow rate may be increased. On the other hand, if the length of the threaded member 33 is increased, pressure is lowered, flow speed is lowered, and thus flow rate may be reduced. In an exemplary embodiment of the present invention, the valve unit 60 is a valve assembly that can selectively eject the gas state phase change material 20 into the housing 2 through the ejection paths 35 under a specific temperature condition in the housing 2 due to heating by turning on the lamp 6 as described above. As such, the valve unit 60 can include a valve body 61, a stopper 71, and a deformable member 81.

For example, the valve body 61 can be threadably-fastened to the upper case 12 and connected with the discharge unit 30. An ejection port 63 connecting the space in the housing 2 with the ejection path 35 is further formed in the valve body 61.

The stopper 71 is disposed so as to selectively open/close the ejection port 63 of the valve body 61. For example, the stopper 71 may be movably disposed in the valve body 61, such as like a spool, and can selectively open/close the ejection port 63.

The deformable member 81 is on which deforms under a specific temperature condition in the housing 2, particularly due to turning-on and heating of the lamp 6. Such deformation results in selective opening/closing of the ejection port 63 of the valve body 61 by means of the stopper 71 which is in connection with the deformable member 81.

For example, the deformable member 81 may be disposed on the valve body 61, supporting the stopper 71. The deformable member 81 may be made of a bimetal material or any other suitable material, which deforms as a result of a temperature change in the housing 2. For example, the deformable member 81 may be in the general form of a plate shape as shown in FIGS. 4 and 5.

The bimetal material may be formed by bonding two sheets of metals having different thermal expansion coefficients. According to an exemplary embodiment, when ambient temperature increases, the bimetal material deforms to the metal having a smaller thermal expansion coefficient of the two kinds of metal, and returns to the initial status when the ambient temperature decreases.

Bimetal materials and structures are known in the art, and the present bimetal material can be in accordance with such known materials and structures. As such, the material and structure is not further described in detail herein.

The deformable member 81 may be fastened to the top of the valve body 61 by any suitable fastening means, such as through the bolts 15. As shown in FIGS. 4-5, the deformable member 81 may be fixed to the top of the valve body 61 so as to cover the stopper 71.

In this configuration, the deformable member 81 is made of a bimetal material that can deform at a predetermined temperature condition in the housing 2, for example, 50±10° C., and may deform so as to bend upward as in the figures at the predetermined temperature condition.

In particular, when the internal temperature of the housing 2 satisfies the predetermined temperature condition, the deformable member 81 may deform while bending upward. In this upwardly bent state, the stopper 71 is moved upward in proportion to the deformation amount of the deformable member 81 by ejection pressure of the gas state phase change material 20 which is within the ejection paths 35 of the discharge unit 30. As such, the ejection pressure opens the ejection port 63 of the valve body 61 to release the phase change material 20 in a gas state.

Further, when the internal temperature of the housing 2 drops below the predetermined temperature condition, the deformable member 81 may return to the initial shape. In this operation, the stopper 71 is moved downward by a restoring force of the deformable member 81, thereby closing the ejection port 63 of the valve body 61.

The operation and operational effect of the structure 100 for removing moisture of a headlamp equipped with the phase change material injection device 200 according to the exemplary embodiment of the present which has the configuration described above are described hereafter with reference to the drawings.

FIG. 5 is a cross-sectional view showing the exemplary embodiment of the phase change material injection device 200 to illustrate the operation process of the phase change material injection device 200 according to an exemplary embodiment of the present invention.

First, in an exemplary embodiment of the present, the temperature in the housing 2 is less than a predetermined temperature condition (e.g., 50±10° C.) as in FIGS. 1 and 4 when the lamps are not turned on to heat the housing. As such, the deformable member 81 holds the stopper 71 downward without deforming and keeps the ejection port 63 closed by means of the stopper 71.

In this status, when the temperature in the housing 2 increases, due to turning-on and heating of the lamp 6, and satisfies the predetermined temperature condition, the liquid state phase change material 20 in the container 10 is changed into a gas state by heat.

In this process, the deformable member 81 deforms while bending upward to the part having a smaller thermal expansion coefficient by heat, as in FIG. 5. The stopper 71 is moved upward in proportion to the deformation amount of the deformable member 81 by ejection pressure of the gas state phase change material 20 which is within the ejection paths 35 of the discharge unit 30. This ejection pressure opens the ejection port 63 of the valve body 61.

Accordingly, since the ejection paths 35 and the ejection port 63 are connected, the gas state phase change material 20 is discharged from the inside of the container 10 by a predetermined amount through the ejection paths 35, and is ejected into the housing 2 through the ejection port 63.

In this process, some of moisture (water vapor) in the housing 2 is also discharged outside of the housing through the moisture discharge port 8 by the gas state phase change material 20.

Further, as the gas state phase change material 20 is ejected at a low temperature and with high density into the housing 2, the average internal temperature of the housing 2 decreases. As a result, water partial vapor pressure in the housing 2 decreases. Accordingly, the dew point in the housing 2 decreases by about 3-5° C., and thus fogging is prevented.

Further, in an exemplary embodiment of the present invention, when the internal temperature of the housing 2 drops below the predetermined temperature condition, the deformable member 81 returns to the initial shape and the stopper 71 is moved down by the restoring force of the deformable member 81 to close the ejection port 63 of the valve body 61.

As described above, the structure 100 for removing moisture of a headlamp according to the present invention makes it possible to prevent moisture from being generated in a vehicle headlamp, particularly by decreasing the dew point temperature in the housing 2. In particular, the present invention ejects a phase change material, which has been changed into a gas state from a liquid state by the heat generated by the lamp 6, into the housing 2 to thus lower the dew point temperature in the housing 2.

Further, the present invention makes it possible to eject a phase change material in a gas state into the housing 2 under a specific temperature condition in the housing 2 due to turning-on and heating of the lamp 6, particularly by using a bimetal. As such, the present device does not require a specific sensor or electronic device, and it is further possible to control the ejection amount of the phase change material by means of the threaded members 33.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A phase change material injection device that is disposed within a housing in which a predetermined heat source is housed, the phase change material injection device ejecting a phase change material which has been changed from a liquid into a gas by heat of the heat source, into the housing, the device comprising:

a container storing the phase change material in a liquid state;

a discharge unit disposed at the container and configured for discharging a predetermined amount of the phase change material in a gas state into the housing, wherein the discharge unit includes:

an outlet formed at an upper portion of the container for allowing the phase change material in a gas state to be discharged therethrough; and at least one threaded member threadably-fastened to the outlet, the threaded member forming an ejection path through which the phase change material is ejected in a gas state in a controlled amount; and a valve unit having an ejection port connecting the discharge unit with the inside of the housing, the valve unit disposed at the container and being configured for selectively opening and closing the ejection port based on an internal temperature of the housing.

2. The device of claim 1, wherein the container includes:

a lower case; and an upper case, wherein an upper portion of the lower case is attachable to a lower portion of the upper case to thereby form a space in which the phase change material is disposed in a liquid state.

3. The device of claim 1, wherein the ejection path is formed between the inner side of the outlet and the threads of the threaded member.

4. The device of claim 1, wherein the discharge unit controls the discharge amount of the phase change material in a gas state through the discharge path based on the number of threads and length of the threaded member.

5. The device of claim 1, wherein the threaded member is disposed at both the upper portion and the lower portion of the outlet.

6. The device of claim 1, wherein the valve unit includes:

a valve body having the ejection port and being coupled to the upper portion of the container;

a stopper movably disposed in the valve body so as to selectively open and close the ejection port; and a deformable member disposed at the valve body and supporting the stopper, the deformable member being made of a bimetal and being deformable based on an internal temperature of the housing.

7. The device of claim 6, wherein the deformable member is disposed at the valve body and at least partially covers the stopper.

8. The device of claim 6, wherein the stopper is movable by ejection pressure of the phase change material when the deformable member is deformed, and the stopper is not movable by ejection pressure of the phase change material when the deformable member is not deformed.

9. A structure for removing moisture produced in a housing of a vehicle headlamp, wherein a lamp as a heat source is disposed in the housing, the structure comprising:

a phase change material injection device as set forth in claim 1, which is disposed in the housing so as to ejects the phase change material, which has been changed into a gas from liquid by heating of the lamp, into the housing.

10. The structure of claim 9, wherein the phase change material injection device is disposed on a bottom surface of the housing.

11. The structure of claim 9, wherein a moisture discharge port for discharging moisture is formed in the housing.

* * * * *